US005426874A

United States Patent [19]

Nakata et al.

[11] Patent Number: 5,426,874

[45] Date of Patent: Jun. 27, 1995

[54] SCRAPER BLADE CONTROL APPARATUS

[75] Inventors: Kazushi Nakata; Shigenori Matsushita; Shigeru Yamamoto; Shu h-uai Zhang; Satoru Nihsida, all of Osaka, Japan

[73] Assignee: Kabushiki Kaisha Komatsu Seisakusho, Tokyo, Japan

[21] Appl. No.: 248,197

[22] Filed: May 24, 1994

[30] Foreign Application Priority Data

May 24, 1993 [JP] Japan ..... 5-031836 U

[51] Int. Cl.[6] ..... E02F 3/28

[52] U.S. Cl. ..... 37/348; 74/471 XY; 414/4; 414/699

[58] Field of Search ..... 37/348; 74/471 X, 471 XY, 74/335; 172/10, 11; 414/4, 685, 699; 180/333, 334, 336

[56] References Cited

U.S. PATENT DOCUMENTS

| | | | |
|---|---|---|---|
| 4,656,461 | 4/1987 | Morsch et al. | 74/471 XY X |
| 4,863,337 | 9/1989 | Ishiguro et al. | 414/699 |
| 5,042,314 | 8/1991 | Rytter et al. | 74/335 |
| 5,176,041 | 1/1993 | Meier et al. | 74/471 XY |
| 5,184,646 | 2/1993 | Hori et al. | 74/471 XY X |
| 5,285,861 | 2/1994 | Nakamura | 74/471 XY X |
| 5,288,198 | 2/1994 | Mozingo | 414/685 |
| 5,293,900 | 3/1994 | Karbassi et al. | 74/471 XY X |
| 5,312,217 | 5/1994 | Lawrence et al. | 414/4 |
| 5,316,435 | 5/1994 | Mozingo | 414/685 |

*Primary Examiner*—Randolph A. Reese
*Assistant Examiner*—Robert Pezzuto
*Attorney, Agent, or Firm*—Richards, Medlock & Andrews

[57] ABSTRACT

In an apparatus for controlling the vertical movement of a scraper blade (18) of a bulldozer, a four-position hydraulic control valve (12), having HOLD, UP, DOWN, and FLOAT positions, maintains the scraper blade in the FLOAT condition without requiring a detent mechanism, even when the three-position operation lever (1, 51) is released with the hydraulic control valve (12) in the FLOAT position. The operation lever (1, 51), having HOLD, UP, and DOWN positions, provides electrical signals to a controller (4) for actuating the hydraulic control valve (12) with pilot pressures provided via solenoid pilot valves (6, 7). A hydraulic cylinder (19), connected to the scraper blade (18), is actuated by hydraulic oil from the hydraulic control valve (12). A control device (2, 52), for generating an electrical signal for the FLOAT position and transmitting that electrical signal to the controller (4), is provided on the three-position operation lever (1, 51), so that the hydraulic control valve (12) is held at the FLOAT position in response to the electrical signal from the control device (2, 52).

20 Claims, 4 Drawing Sheets

FIG. IB
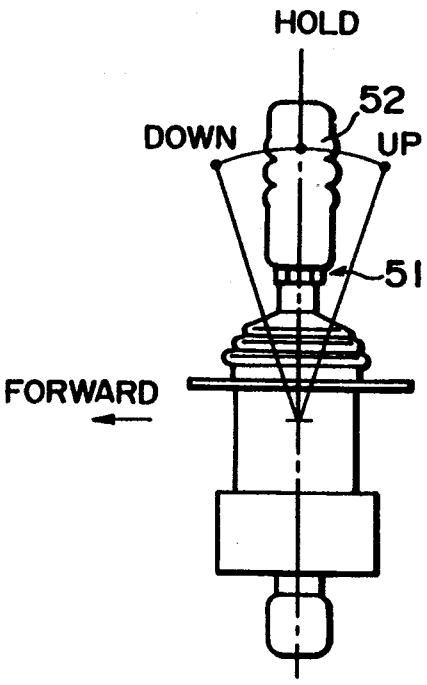
FIG. IA
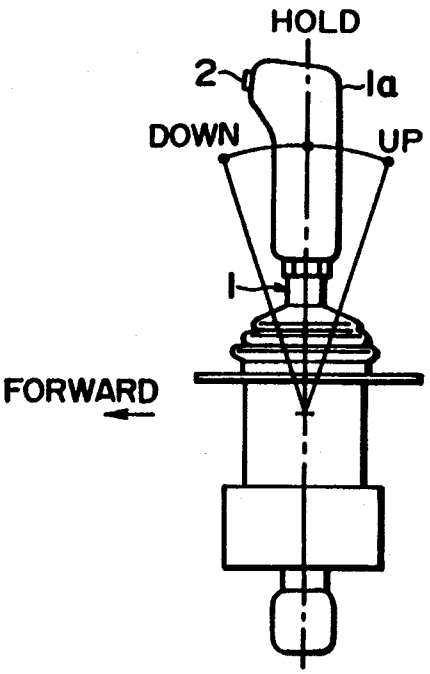

SCRAPER BLADE CONTROL APPARATUS

FIELD OF THE INVENTION

The present invention relates to an improvement in a control apparatus for controlling the positioning of an element. In a particular aspect, the present invention relates to a control apparatus for controlling the vertical positioning of a scraper blade installed on a construction machine, for example, a bulldozer, or the like.

BACKGROUND OF THE INVENTION

A hydraulic circuit diagram of a scraper blade control apparatus installed on a conventional construction machine, such as a bulldozer, is shown in FIG. 3. Hydraulic oil under pressure flows from a discharge port of a hydraulic pump 14 into a hydraulic control valve 20. When an operation lever 21, connected to a valve spool in hydraulic control valve 20, is set at a neutral position, the hydraulic control valve 20 is at the HOLD position, which permits hydraulic oil from pump 14 to pass through the hydraulic control valve 20 and through conduit 22 to an oil reservoir tank 23. At this time, the pressure of the hydraulic oil in each of the conduits 24 and 25, which extend between two ports of the hydraulic control valve 20 and two ports of a hydraulic cylinder 19 for lifting or lowering the scraper blade, is maintained at the current oil pressure level. Therefore, the scraper blade 18 is maintained in a stationary position.

When the valve spool of the hydraulic control valve 20 is moved to the UP position by the manipulation of the operation lever 21, hydraulic oil flows through conduit 24 into the rod side of the hydraulic cylinder 19 to push the piston **19*a* upwardly, while hydraulic oil flows from the piston face side of the hydraulic cylinder 19 through conduit 25, valve 20, and conduit 22 to reservoir tank 23. Accordingly, the scraper blade 18, which is engaged with the rod 19*b* of the hydraulic cylinder 19**, is also moved upwardly.

When the valve spool of the hydraulic control valve 20 is moved to the DOWN position by the manipulation of the operation lever 21, hydraulic oil from pump 14 flows through valve 20 and conduit 25 to the piston face side of the hydraulic cylinder 19, while hydraulic oil flows from the rod side of the hydraulic cylinder 19 through conduit 24, valve 20, conduit 26, and restriction **26*a* to reservoir tank 23. Therefore, the piston 19*a* is pushed downwardly, and the scraper blade 18** is also moved downwardly.

In this case, if the operation lever 21, which has been moved from the HOLD position to the DOWN position, is then moved further in the same direction from the DOWN position, the valve spool of the hydraulic control valve 20 is moved to the FLOAT position. Under the FLOAT condition, hydraulic oil flows from the piston face side of the hydraulic cylinder 19 through conduits 25 and 22 to the oil reservoir tank 23, while hydraulic oil from the rod side of the hydraulic cylinder 19 passes through conduits 24 and 26 and restriction **26*a* to the oil reservoir tank 23. Therefore, the scraper blade 18 is in the FLOAT state, and only the weight of the scraper blade 18 acts on the edge of the scraper blade 18**. Accordingly, when the bulldozer is moved forwardly or rearwardly under this condition, finish leveling of an earth surface can be easily carried out.

The hydraulic control valve 20, having the four setting positions "HOLD", "UP", "DOWN", and "FLOAT", generally incorporates a detent mechanism which serves to maintain the current position of the valve spool of the hydraulic control valve 20 whenever the operation lever 21 is released with the valve spool at the FLOAT position, so as to improve the operation of the scraper blade control system. If the operation lever 21 is released with the valve spool at either the UP position or the DOWN position, the valve spool is automatically returned to the HOLD position by a spring.

A sectional view of a hydraulic control valve 20, internally provided with such a detent mechanism, is shown in FIG. 4. The hydraulic control valve 20 has a valve body **20*a* with an elongated chamber formed therein for receiving a valve spool 27 for reciprocating movement along the longitudinal axis of the chamber. Four types of oil passages are formed in the hydraulic control valve 20 by the operator manually manipulating operation lever 21 (shown in FIG. 3), connected to an extreme left end of the valve spool 27 (as viewed in FIG. 4). Specifically, the hydraulic control valve 20 is set at the UP position when the valve spool 27 is shifted to the left (as shown in FIG. 4) from the HOLD position, is set at the DOWN position when the valve spool 27 is shifted to the right from the HOLD position, and is set at the FLOAT position when the valve spool 27 is shifted still further to the right past the DOWN position. The detent mechanism 31 is provided at the right end of the hydraulic control valve 20. The detent mechanism 31 comprises a ball 28, a push rod 29, and a spring 30, which are positioned in the valve body 20*a* with the ball 28 in contact with the valve spool 27. In such a hydraulic control valve 20, when the operation lever 21 is released with the valve spool 27 at the UP position or at the DOWN position, the valve spool 27 is automatically returned to the neutral HOLD position by the action of the return spring 32**.

However, at the FLOAT position, an annular projection **27*a*, provided on the valve spool 27, has been moved to the right by the valve spool 27 until the annular projection 27*a* is on the right side of the ball 28. While the ball 28 is retracted upwardly into the body 20*a* against the force of the spring 30 as the annular projection 27*a* passes the location of the ball 28, the spring 30 causes the ball to move downwardly against the main portion of the valve spool 27 as soon as the annular projection 27*a* passes the position of the ball 28. In the absence of an actuating force by operation lever 21, the force of the return spring 32 is insufficient to overcome the resistance of the contact of the ball 28 against the left side of the annular projection 27*a*. Thus, the leftward movement of the valve spool 27 from the FLOAT position is prevented until a sufficiently positive leftward motion is applied to the valve spool 27 by the operation lever 21. Accordingly, the valve spool 27 is held at the FLOAT position whenever the operation lever 21 is released with the valve spool 27** in the FLOAT position.

This condition can result in a problem in that the only way of releasing the spool 27 from the FLOAT position is to forcibly move the spool 27, by manipulating the operation lever 21, from the FLOAT state to any of the UP, DOWN and HOLD positions. Therefore, the performance of other operations may encounter difficulties while the operation lever 27 is in its released state and the spool 27 is in the FLOAT position. For example, when the bulldozer is moved forwardly or rearwardly by starting the engine of the bulldozer while valve 20 is at the FLOAT position, the scraper blade is dragged unexpectedly on the earth, and the machine and the earth can be damaged. In addition, the provision of the detent mechanism 31 increases the complexity of the construction of the valve 20 and increases the cost of the system.

In the example shown in FIG. 4, the detent mechanism 31 is installed on the four-position hydraulic control valve 20 which is directly controlled by the operation lever 21. However, in a controller which indirectly controls through hydraulic pilot valves, the detent mechanism can be provided on a special four-position hydraulic pilot valve. Similarly, in an apparatus wherein a controller is actuated by the manipulation of the operation lever to control a solenoid pilot valve and a four-position control valve according to the commands of the controller, the detent mechanism can be installed on the solenoid pilot valve.

SUMMARY OF THE INVENTION

An object of the present invention, made to solve the above-described problems, is to provide a control apparatus capable of holding a hydraulic control valve at a FLOAT position while the operation lever is released, without the necessity of providing a detent mechanism. Another object of the present invention is to provide a scraper blade control apparatus capable of holding a scraper blade in a FLOAT condition even though the operation lever has been released, without the necessity of providing a detent mechanism.

The present invention provides a control apparatus comprising: a three-position operation lever, having HOLD, UP, and DOWN positions, for generating specified electrical signals at respective operating positions of the operation lever for controlling the positioning of an element, for example, a scraper blade installed on a construction machine such as a bulldozer; at least one solenoid pilot valve which is operated in response to an electrical command signal; a controller for providing an electrical command signal to the at least one solenoid valve in response to electrical input signals including a specified electrical signal from said operation lever; a four-position hydraulic control valve which is selectively operated to HOLD, UP, DOWN and FLOAT positions according to pilot pressure from the at least one solenoid pilot valve; a hydraulic cylinder which is operated by hydraulic oil supplied from the hydraulic control valve; and a control device for generating an electrical signal for the FLOAT position and inputting that electrical signal to the controller, the control device being provided on the three-position operation lever. The control device can be a push button or a grip sensor. Also, a sensor can provide the controller with an electrical signal corresponding to the revolutions of the engine, e.g., revolutions per minute.

The above configuration of the control apparatus enables the implementation of the HOLD, UP, DOWN and FLOAT conditions without the necessity of using a detent mechanism. Various techniques can be employed to cause the controller to cancel the electrical command signal representing the FLOAT condition. For example, when the engine is to be started, the FLOAT position can be automatically canceled by inputting an engine revolutions signal to the controller. Similarly, the operations of the three-position operation lever and the controller can be combined to cancel the electrical command signal representing the FLOAT condition.

BRIEF DESCRIPTION OF THE DRAWINGS

FIG. 1A is a side view of an operation lever according to a first embodiment of the present invention;

FIG. 1B is a side view of an operation lever according to a second embodiment of the present invention;

BEST MODE FOR CARRYING OUT THE INVENTION

Figure 2:
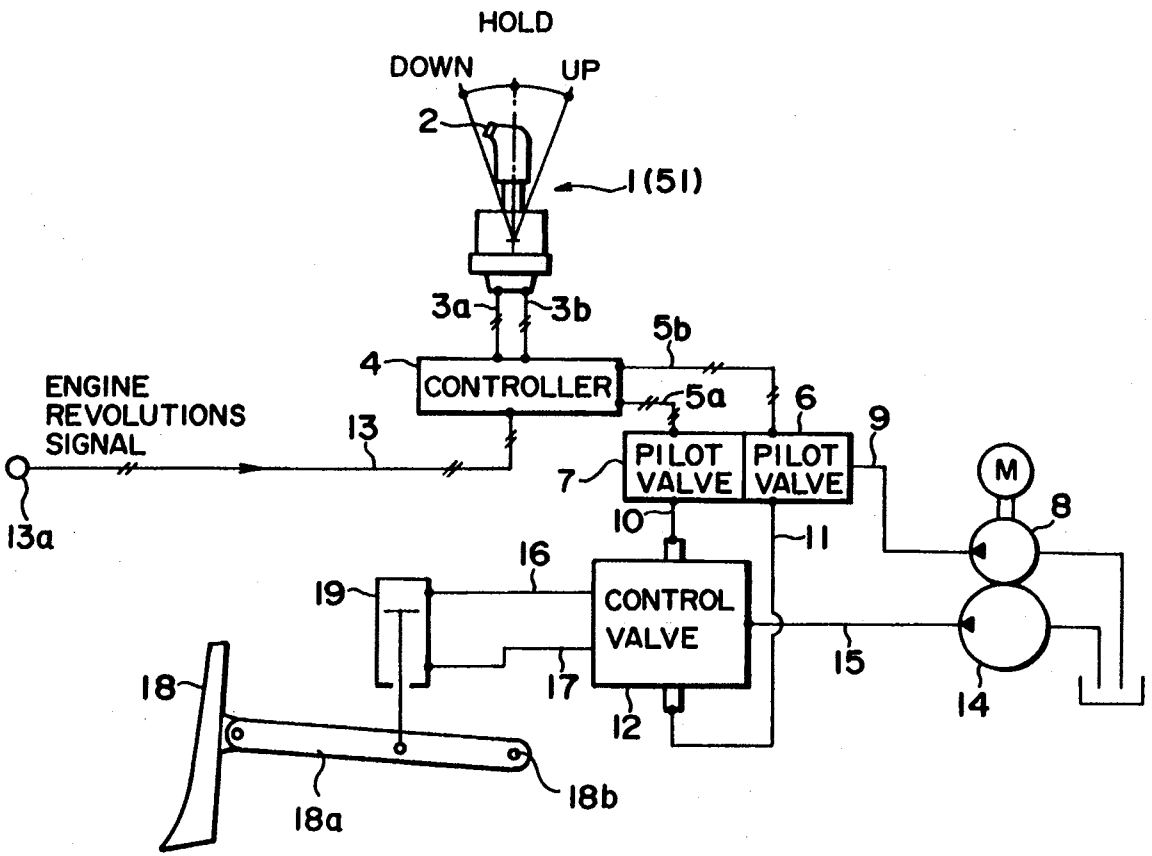
FIG. 2 is an electro-hydraulic circuit diagram of a scraper blade control apparatus according to the present invention employing the operation lever of FIG. 1A.
Figure 3:
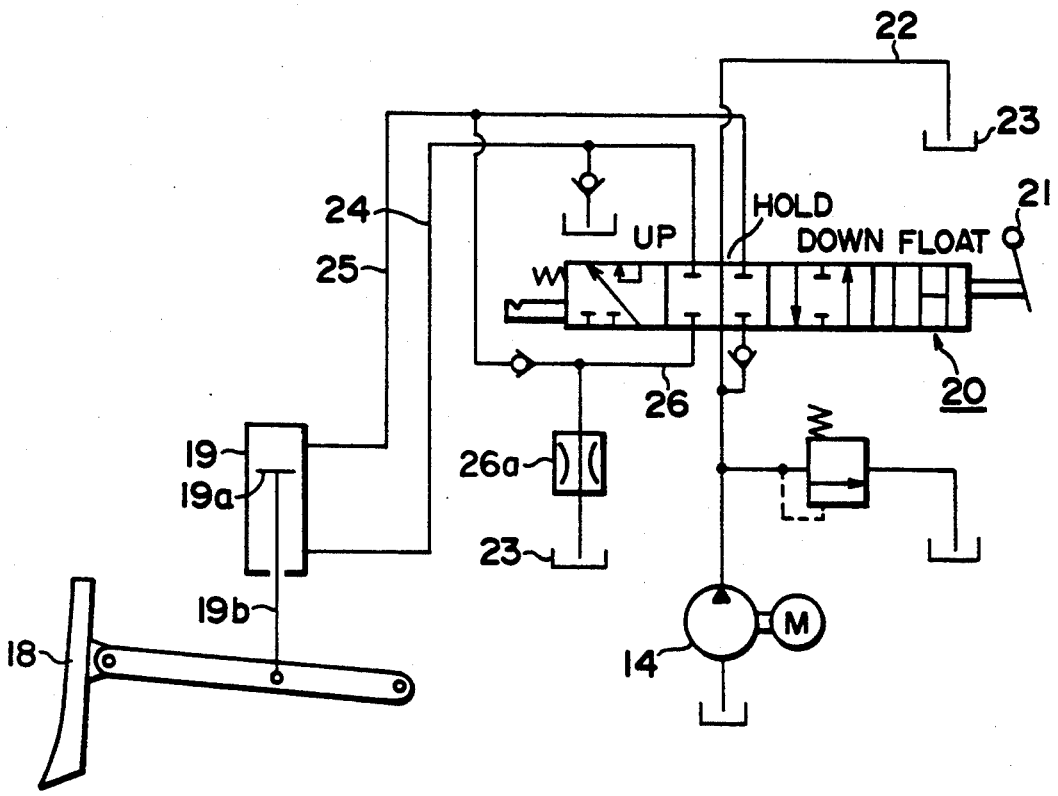
FIG. 3 (PRIOR ART)
FIG. 3 is a hydraulic circuit diagram of a scraper blade control apparatus according to the related art.
Figure 4:
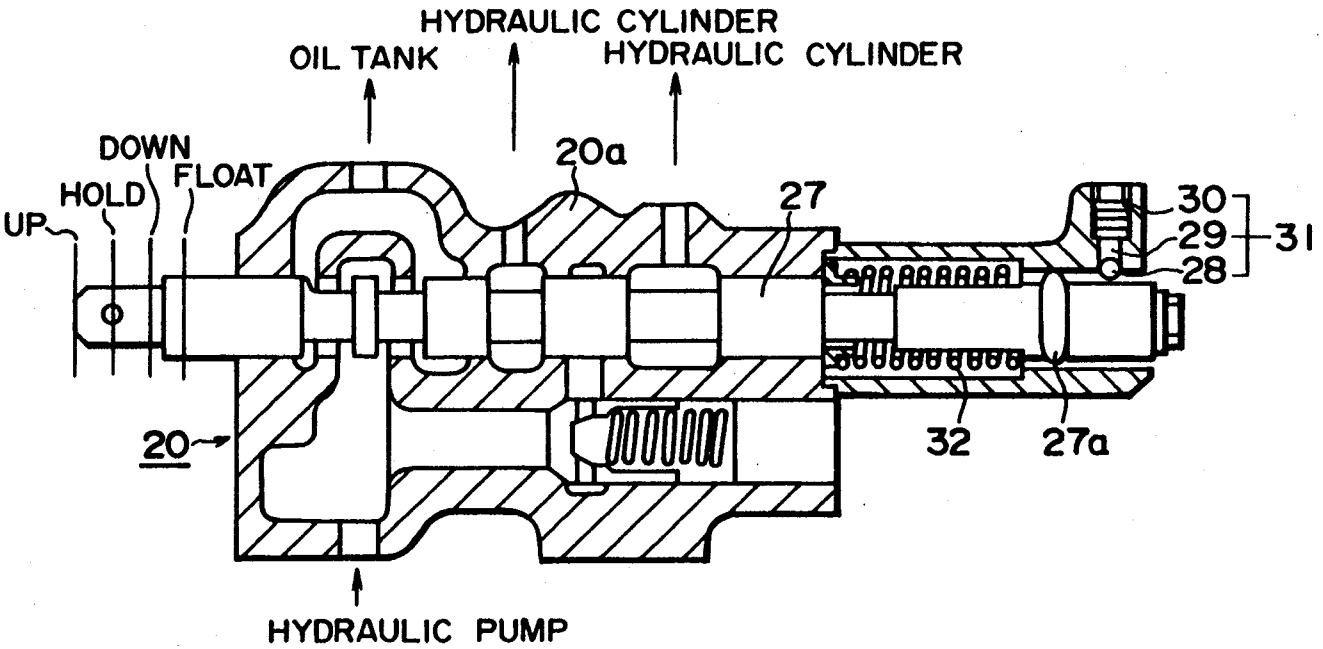
FIG. 4 (PRIOR ART)
FIG. 4 is a sectional view of a hydraulic control valve to be employed in the control apparatus according to the related art.

An embodiment of a scraper blade control apparatus according to the present invention is described below, referring to FIGS. 1A, 1B, and 2.

A three-position operation lever 1 has only three positions, i.e., UP, DOWN and HOLD. The operation lever 1 is set to the HOLD position as a neutral setting, is set to the DOWN position when it is manually moved forwardly by the operator from the HOLD position, and is set to the UP position when it is manually moved rearwardly by the operator from the HOLD position, so as to output a respective specified electrical signal to a controller 4 for each of the three positions. The terms "forwardly" and "rearwardly" indicate the presently preferred orientation of the operating lever i with respect to the construction machine, but other directions can be employed. A push button 2 can be provided, as the FLOAT position control device, on the knob 1*a* of the operation lever 1, as shown in FIG. 1A, and an electrical signal corresponding to the FLOAT condition is outputted to the controller 4 by the operator pressing the push button 2 while holding the knob 1*a*. As an alternative, an electrical signal corresponding to the FLOAT condition can be outputted to the controller 4 by the operator gripping an operation lever 51 which is provided with a grip sensor 52 serving as the FLOAT control device, as shown in FIG. 1B. While the push button 2 and the grip sensor 52 have been illustrated, any other suitable control device can be utilized to provide controller 4 with an electrical signal indicating that the operator desires the FLOAT condition. The control device can be mounted in any suitable position on the operation lever, e.g., on the front, on either side, on the top, etc., so as to facilitate the operation thereof by the operator.

The electro-hydraulic circuit of the scraper blade control apparatus and its functions are described below with reference to FIG. 2.

The three-position operation lever 1 or 51 is connected to the controller 4 by electrical leads 3*a* and 3*b* so that the respective specified electrical signals generated by the operation lever 1 or 51 at respective operating positions of the operation lever 1 or 51 and the electrical signal from the control device 2 or 52 are inputted to the controller 4. A first output of the controller 4 is connected to solenoid pilot valve 6 by electrical lead 5*b* while a second output of the controller 4 is connected to solenoid pilot valve 7 by electrical lead 5*a*, to enable the controller 4 to output an electrical control signal to the solenoid of solenoid pilot valve 6 and/or the solenoid of solenoid pilot valve 7. The hydraulic input port of each of the solenoid pilot valves 6 and 7 is connected to the discharging side of the pilot hydraulic pump 8 by a conduit 9, while the hydraulic output port of solenoid pilot valve 6 is connected by a conduit 11 to a first control port of hydraulic control valve 12 and the hydraulic output port of solenoid pilot valve 7 is connected by a conduit. 10 to a second control port of hydraulic control valve 12. An electrical signal corresponding to the revolutions of the engine is outputted by a sensor 13*a* and transmitted to the controller 4 through an electrical lead 13.

When the pilot pressures in the two control ports of hydraulic control valve 12 have only two levels, i.e. "high" and "low", there are four possible combinations, i.e. "high" and "high", "high" and "low", "low" and "high", and "low" and "low". The hydraulic control valve can be provided with one or more springs to assist in the positioning of the valve spool of the hydraulic control valve 12 in one or more of the four positions. Instead of solenoid valves having only two output pressure levels, proportional solenoid valves which produce a variable output pressure proportional to the electrical input signal can be employed. While two solenoid valves 6 and 7 have been illustrated, either a single solenoid valve or a plurality of solenoid valves can be employed in combination with one or more springs to achieve the desired one of the four positions of hydraulic control valve 12, i.e., UP, HOLD, DOWN, and FLOAT.

The discharging side of the main hydraulic pump 14 is connected to the hydraulic fluid input port of four-position hydraulic control valve 12 by a conduit 15, one hydraulic fluid output port of the hydraulic control valve 12 is connected by conduit 16 to the piston face side port of hydraulic cylinder 19 while another hydraulic fluid output port of the hydraulic control valve 12 is connected by conduit 17 to the rod side port of hydraulic cylinder 19. The rod of hydraulic cylinder 19 is connected to a support element 18*a*. One end of support element 18a is pivotally connected to scraper blade 18 while the other end of support element 18*a* is mounted for pivotal movement about a pivot pin 18*b* which is part of the construction machine. Thus, the actuation of the hydraulic cylinder 19 controls the vertical positioning of the scraper blade 18.

In the control apparatus as described above, when the operation lever 1 or 51 is set to the UP position by the operator manually moving it rearwardly from the HOLD position, the controller 4 controls solenoid pilot valves 6 and 7 to alter the pressure differential between the hydraulic fluid in the two control ports of hydraulic control valve 12 so that the hydraulic control valve 12 is set to the UP position.

In the control apparatus as described above, when the operation lever 1 or 51 is set to the DOWN position by the operator manually moving it forwardly from the HOLD position and the control device 2 or 52 is not actuated, the controller 4 controls solenoid pilot valves 6 and 7 to alter the pressure differential between the hydraulic fluid in the two control ports of hydraulic control valve 12 so that the hydraulic control valve 12 is set to the DOWN position.

In the control apparatus as described above, when the operation lever 1 is set to the DOWN position by the operator manually moving it forwardly from the HOLD position and the push button 2 is pressed, the controller 4 controls solenoid pilot valves 6 and 7 to alter the pressure differential between the hydraulic fluid in the two control ports of hydraulic control valve 12 so that the hydraulic control valve 12 is set to the FLOAT position. Similarly, in the case of the operation lever 51, provided with the grip sensor 52, when the grip sensor 52 of the operation lever 51 is gripped, the controller 4 controls the solenoid pilot valves 6 and 7 to cause the hydraulic control valve 12 to be set to the FLOAT position.

The hydraulic control valve 12 can be provided with a return spring so that the valve spool of valve 12 is automatically returned to the HOLD position from either the UP position or the DOWN position upon the operator releasing the operation lever 1, except in the situation where the operator has placed the operation lever 1 in the DOWN position while actuating the control device 2 or 52 indicating that the FLOAT condition is desired. In the latter situation, the hydraulic control valve 12 remains in the FLOAT position even though the operator has released the operation lever 1.

Thus, in the situation of either type of operation lever 1 or 51 being placed in the HOLD position and the control device 2 or 52 being actuated to achieve the FLOAT position, when the operator manually releases the operation lever 1 or 51, the operation lever 1 or 51 is automatically reset to the HOLD position for the operation lever 1 or 51 while the hydraulic control valve 12 is held at the FLOAT position by the action of the controller 4. The control apparatus can be constructed so that this FLOAT condition is displayed on a monitor (not shown) in the operator cabin of the construction machine.

One or more of the following operations can be employed to cancel the FLOAT condition of the hydraulic control valve 12:

(1) The operator can press again the control device 2 or 52 of the operation lever 1 or 51 to thereby cancel the electrical FLOAT condition signal, which is being outputted by the controller 4 to the solenoid pilot valves 6 and 7. The cancellation of the FLOAT condition signal while the operation lever 1 or 51 has been released by the operator will automatically return the spool of hydraulic control valve 12 to the HOLD position.

(2) Manually set the operation lever 1 or 51 to either the UP position or the DOWN position.

(3) Stop the engine, whereby the sensor 13*a* provides to the controller 4 an engine revolutions signal which indicates that the engine is stopped, so that the controller cancels the FLOAT condition signal.

(4) Restart the engine from a stopped condition, with the sensor 13*a* providing the controller 4 with an engine revolutions signal that the engine has been changed from a stopped condition to an operating condition, so that the controller cancels any FLOAT condition signal which exists.

The scraper blade control apparatus with the above-described construction does not require a detent mechanism on any of the valves for maintaining the hydraulic control valve 12 at the FLOAT position. Therefore, the construction of the system is simpler and the costs are reduced. When the engine is started from the stopped condition with the hydraulic control valve 12 at the FLOAT position, the hydraulic control valve 12 can be automatically reset to the HOLD position by a command of the controller 4 in response to the output signal from RPM sensor 13*a*. Even though the bulldozer is moved forwardly or rearwardly with the operation lever 1 or 51 in the HOLD state, the scraper blade 18 will not be automatically dragged on the ground, and therefore damage to the machine and the ground surface can be avoided.

What is claimed is:

1. Apparatus for controlling the positioning of an element, said apparatus comprising:

a three-position operation lever having HOLD, UP, and DOWN positions, said operation lever being actuatable by an operator for generating specified electrical signals at respective operating positions of the operation lever for controlling the positioning of said element;

at least one solenoid pilot valve which is operated in response to an electrical command signal;

a controller for providing an electrical command signal to the at least one solenoid pilot valve in response to at least one electrical signal including a specified electrical signal from said operation lever;

a four-position hydraulic control valve having HOLD, UP, DOWN, and FLOAT positions, wherein said hydraulic control valve is selectively actuated to a respective one of the HOLD, UP, DOWN and FLOAT positions in response to pilot pressure from said at least one solenoid pilot valve;

a hydraulic cylinder which is operated by hydraulic oil supplied from the hydraulic control valve; and a control device for generating an electrical signal indicating that the FLOAT position is desired and for inputting to the controller the electrical signal indicating that the FLOAT position is desired, whereby said controller causes said at least one solenoid pilot valve to move said hydraulic control valve to the FLOAT position in response to an actuation of said control device and to maintain said hydraulic control valve at the FLOAT position upon the release of the operation lever by the operator.

2. Apparatus in accordance with claim 1, wherein said control device is mounted on said three-position operation lever.

3. Apparatus in accordance with claim 1, wherein said element is a scraper blade installed on a construction machine and said apparatus controls the vertical positioning of said scraper blade.

4. Apparatus in accordance with claim 1, wherein said control device is a push button which is provided on said three-position operation lever to generate an electrical signal indicating that the FLOAT position is desired.

5. Apparatus in accordance with claim 1, wherein said control device is a grip sensor which is provided on said three-position operation lever to generate an electrical signal indicating that the FLOAT position is desired.

6. Apparatus in accordance with claim 1, wherein said element is a scraper blade installed on a construction machine and said apparatus controls the vertical positioning of said scraper blade, said construction machine having an engine, said apparatus further comprising a sensor for producing an electrical signal representative of the revolutions of said engine and inputting to said controller said electrical signal representative of the revolutions of said engine.

7. Apparatus in accordance with claim 6, wherein said controller causes said at least one solenoid pilot valve to move said hydraulic control valve from the FLOAT position in response to an electrical signal representative of the revolutions of said engine.

8. Apparatus in accordance with claim 1, wherein said at least one solenoid pilot valve comprises a first solenoid pilot valve and a second solenoid pilot valve, wherein said hydraulic control valve has a first control port and a second control port, wherein an output port of said first solenoid pilot valve is connected to said first control port of said hydraulic control valve to apply a pilot pressure thereto, wherein an output port of said second solenoid pilot valve is connected to said second control port of said hydraulic control valve to apply a pilot pressure thereto, so that a difference between a pilot pressure in said first control port and a pilot pressure in said second control port determines the position of said hydraulic control valve.

9. Apparatus in accordance with claim 8, wherein said control device is mounted on said three-position operation lever.

10. Apparatus in accordance with claim 9, wherein said control device is a push button to generate an electrical signal indicating that the FLOAT position is desired.

11. Apparatus in accordance with claim 9, wherein said control device is a grip sensor to generate an electrical signal indicating that the FLOAT position is desired.

12. Apparatus in accordance with claim 8, wherein said element is a scraper blade installed on a construction machine and said apparatus controls the vertical positioning of said scraper blade.

13. Apparatus in accordance with claim 12, wherein said construction machine has an engine, and wherein said apparatus further comprises a sensor for producing an electrical signal representative of the revolutions of said engine and inputting to said controller said electrical signal representative of the revolutions of said engine.

14. Apparatus in accordance with claim 13, wherein said controller causes said first and second pilot valves to move said hydraulic control valve from the FLOAT position in response to an electrical signal representative of the revolutions of said engine.

15. A construction machine having a scraper blade and an apparatus for controlling the vertical positioning of said scraper blade, said apparatus comprising:

a three-position manually actuatable operation lever having HOLD, UP, and DOWN positions, said operation lever being actuatable by an operator for generating specified electrical signals at respective operating positions of the operation lever for controlling the positioning of said scraper blade;

at least one solenoid pilot valve which is operated in response to an electrical command signal;

a controller for providing an electrical command signal to the at least one solenoid pilot valve in response to at least one electrical signal including a specified electrical signal from said operation lever;

a four-position hydraulic control valve having HOLD, UP, DOWN, and FLOAT positions, wherein said hydraulic control valve is selectively actuated to a respective one of the HOLD, UP, DOWN, and FLOAT positions in response to pilot pressure from said at least one solenoid pilot valve;

a hydraulic cylinder which is operated by hydraulic oil supplied from the hydraulic control valve, said hydraulic cylinder being adapted to move said scraper blade; and a control device for generating an electrical signal indicating that the FLOAT position is desired and for inputting to the controller the electrical signal indicating that the FLOAT position is desired, whereby said controller causes said at least one solenoid pilot valve to move said hydraulic control valve to the FLOAT position in response to an actuation of said control device and to maintain said hydraulic control valve at the FLOAT position upon the release of the operation lever by the operator.

16. A construction machine in accordance with claim 15, further comprising an engine, and a sensor for producing an electrical signal representative of the revolutions of said engine and inputting to said controller said electrical signal representative of the revolutions of said engine.

17. A construction machine in accordance with claim 16, wherein said controller causes said at least one solenoid pilot valve to move said hydraulic control valve from the FLOAT position in response to an electrical signal representative of the revolutions of said engine.

18. A construction machine in accordance with claim 15, wherein said at least one solenoid pilot valve comprises a first solenoid pilot valve and a second solenoid pilot valve, wherein said hydraulic control valve has a first control port and a second control port, wherein an output port of said first solenoid pilot valve is connected to said first control port of said hydraulic control valve to apply a pilot pressure thereto, wherein an output port of said second solenoid pilot valve is connected to said second control port of said hydraulic control valve to apply a pilot pressure thereto, so that a difference between a pilot pressure in said first control port and a pilot pressure in said second control port determines the position of said hydraulic control valve.

19. A construction machine in accordance with claim 18, further comprising an engine, and a sensor for producing an electrical signal representative of the revolutions of said engine and inputting to said controller said electrical signal representative of the revolutions of said engine.

20. A construction machine in accordance with claim 19, wherein said controller causes said first and second solenoid pilot valves to move said hydraulic control valve from the FLOAT position in response to an electrical signal representative of the revolutions of said engine.

* * * * *

UNITED STATES PATENT AND TRADEMARK OFFICE

CERTIFICATE OF CORRECTION

PATENT NO. : 5,426,874

DATED : June 27, 1995

INVENTOR(S) : Kazushi NAKATA et al

It is certified that error appears in the above-indentified patent and that said Letters Patent is hereby corrected as shown below:

Title page, Item [75], delete "Nihsida" and insert --Nishida--.

Signed and Sealed this

Seventeenth Day of October, 1995

*Attest:*

Bruce Lehman

BRUCE LEHMAN

*Attesting Officer*

*Commissioner of Patents and Trademarks*